United States Patent [19]

Rao et al.

[11] 4,291,289

[45] Sep. 22, 1981

[54] SHIELDED SURFACE WAVE TRANSMISSION LINE

[75] Inventors: Basrur R. Rao; Gerald F. Ross; Harry M. Cronson, all of Lexington, Mass.

[73] Assignee: Sperry Corporation, New York, N.Y.

[21] Appl. No.: 130,951

[22] Filed: Mar. 17, 1980

[51] Int. Cl.[3] ..... H01P 1/30

[52] U.S. Cl. ..... 333/240; 246/187 C; 333/248; 455/41

[58] Field of Search ..... 333/109, 113, 237, 240, 333/245, 248; 179/82; 246/8, 30, 63 R, 62 C, 187 C; 340/22; 455/41

[56] References Cited

U.S. PATENT DOCUMENTS

| | | | |
|---|---|---|---|
| 3,534,303 | 10/1970 | Hafner | 333/240 |
| 3,681,717 | 8/1972 | Martin | 333/237 |
| 3,781,687 | 12/1973 | Nakahara et al. | 333/237 X |

*Primary Examiner*—Paul L. Gensler

*Attorney, Agent, or Firm*—Howard P. Terry; Seymour Levine

[57] ABSTRACT

A surface wave transmission line enclosed in a dielectric shield and supported within the enclosure at a predetermined distance from the base of the enclosure. The enclosure being constructed such that the surface wave transmission line may be in close proximity to reflecting objects positioned along the enclosure and at a predetermined distance from a mounting structure.

8 Claims, 7 Drawing Figures

SHIELDED SURFACE WAVE TRANSMISSION LINE

BACKGROUND OF THE INVENTION

1. Field of the Invention

The subject invention pertains to the field of transmission lines and more particularly to a surface wave guiding structure which is self-supporting and exhibits minimum attenuation and dispersion characteristics.

2. Description of the Prior Art

Communication and short electromagnetic guided wave reflectometer control systems for constrained vehicle ground transportation require guiding structures along the right of way. These guiding structures must exhibit minimum attenuation and dispersion characteristics, must possess surface wave fields that extend a sufficient distance from the structure to couple to the vehicle and objects placed adjacent to the right of way, must be self-supporting, and must operate reliably in adverse weather conditions. Surface wave and leaky wave transmission lines such as the dielectric image line, Goubau line, slotted and braided coaxial lines, and trough and W-lines do not possess all these required characteristics. Dielectric image lines are highly dispersive and cause significant pulse broadening which degrades the range resolution of the system, while conventional Goubau lines are not self-supporting and are adversely affected by environmental conditions such as ice and snow. Leaky coaxial cables exhibit excessive loss and quasi TEM lines such as the W-line and a metallic and dielectric shielded Goubau lines, due to the shielding thereof are very insensitive to external objects. A transmission line disclosed in U.S. Pat. No 4,188,595, issued Feb. 26, 1980 by Cronson et al and assigned to the assignee of the present invention is self-supporting, exhibits the required electrical properties, and provides significant improvement in environmental protection over the other transmission lines in the prior art. Applications exist, however, that require environmental protection which exceeds even that provided by the transmission lines disclosed by Cronson et al.

The present invention provides a self-supporting surface wave guiding structure for vehicle control and communication systems, which exhibits minimum attenuation and dispersion characteristics and provides environmental protection that exceeds the protection provided by the transmission line disclosed in U.S. Pat. No. 4,188,595.

SUMMARY OF THE INVENTION

In accordance with the present invention there is provided a surface wave transmission line on which electromagnetic pulse signals may propagate with minimum pulse distortion and attenuation. This transmission line is a self-supporting structure which comprises surface wave guide for guiding electromagnetic waves mounted at a location adjacent to a protective shield and held thereat with a block of low dielectric constant material. The shield, surface wave guide, and location maintaining block assembly is inserted into an asymmetrical C-shaped channel with the surface wave guide positioned in the open end thereof. The over-all assembly may be mounted on a vertical surface with the long side of the asymmetrical C-shaped channel positioned at the top to protect the shield, surface wave guide, and location maintaining block assembly from adverse weather conditions and debris.

DESCRIPTION OF THE PREFERRED EMBODIMENT

Figure 1:
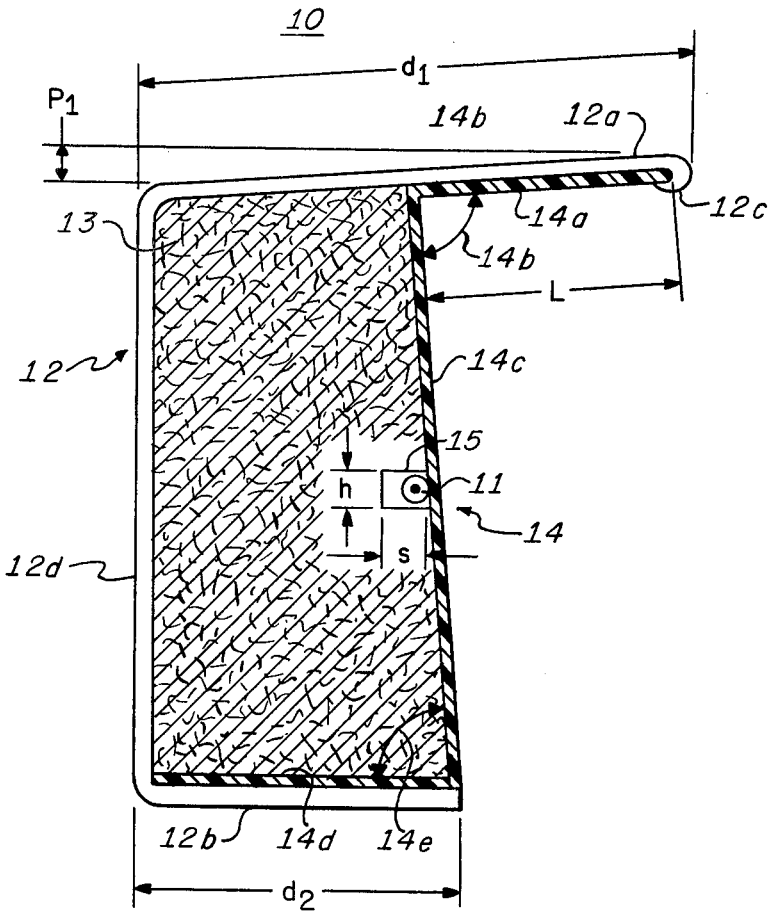
FIGS. 1, 2, 3, 4 and 5 are cross-sectional views of preferred embodiments of the invention.

FIG. 1 shows a cross-sectional view of an embodiment of a shielded surface wave transmission line 10, which may comprise a surface wave guiding structure 11 for guiding electromagnetic signals, positioned to be substantially midway between the upper and lower sections of an asymmetrical C-shaped channel 12. C-shaped channel 12 is constructed such that the upper section **12*a* is longer than the lower section of 12*b* with an interconnecting section 12*d* therebetween. The surface wave guiding structure 11 is supported at its location within the C-shaped channel 12 by a low density plastic foam material 13 and a Z-shaped shield 14 that is held in place by a locking edge 12*c* on C-shaped channel 12. The Z-shaped shield 14 contains the surface wave guiding structure 11 and the plastic foam material 13 within the C-shaped channel 12** and provides protection therefor from the environment and missile impact.

As presently preferred, C-shaped channel 12 may be constructed of ⅛ inch polyvinyl chloride (PVC) with the length $d_1$ of the upper section **12*a* being 6.5 inches (16.51 cm) and having a pitch $P_1$ of 13/16 inch (2.06 cm), the back section 12*d* having a dimension of 8 inches (20.32 cm), and the lower section 12*b* having a dimension $d_2$ of 4.25 inches (10.8 cm). The support structure 13 positioned within C-shaped channel 12 may be of a material such as STYROFOAM with a 2 lbs/cu ft (32.04 kg/cu m) density and a relative dielectric constant of 1.03. A notch of a height h in the order of 0.131 inches (0.33 cm) and a depth s of 0.25 inches (0.64 cm) is positioned on the side of the support structure 13 facing the open end of the C-shaped channel 12 to be substantially midway between the upper section 12*a* and the lower section 12*b*. The surface wave guiding structure, which may be a number 10 gauge solid copper wire with a dielectric coating, as for example, TEFLON of 15 mil (0.038 cm) thickness and 600 volt rating, is inserted into the slot 15 to be secured and protected therein by the shield 14. The height h of the slot 15 is chosen to hold the surface wave guiding structure 11 snugly in position, while the depth s is selected to allow for buckling of the surface of wave guiding structure 11 resulting from thermal expansion. The Z-shaped shield 14 may be constructed of 1/16 inch thick HY-PACT POLYMER an ultra high molecular weight polyethylene (UHMWP) having a dielectric constant of substantially 2.45 and a loss tangent of substantially 0.000251. The upper and forward section 14*a* of Z-shaped shield 14 may have a length L substantially equal to 3.5 inches and may form an angle 14*b* of substantially 90° with interconnecting section 14*c* of the Z-shaped shield 14. Lower section 14*d* of the Z-shaped shield 14 may have a length that is substantially equal to the internal dimension of the lower section 12*b* of the C-shaped channel 12 and may form an angle 14*e* of substantially 83° with the interconnecting section 14*c***.

Figure 2:
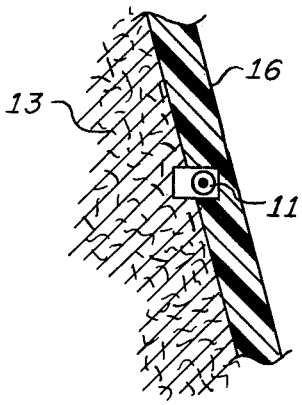
Figure 3:
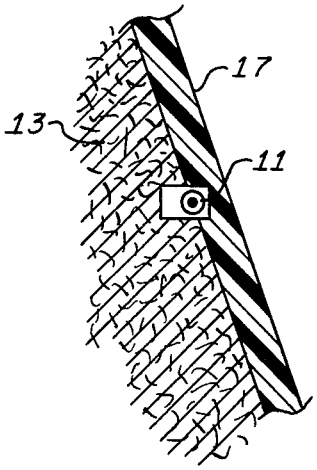

Though the surface wave guiding structure 11 is supported entirely within supporting structure 12 in FIG. 1, other means of support may be provided. In FIG. 2, an alternate supporting means is shown wherein the surface guiding structure 11 may be supported completely within the interconnecting section 16 of the Z-shaped shield and clearance for buckling due to thermal expansion may be provided in the low dielectric constant material. While in FIG. 3 another supporting means is shown wherein the surface wave guiding structure 11 may be positioned partially in the interconnecting section 17 of the Z-shaped field and partially within the low dielectric constant material. It should be recognized transitional sections 15 and 17 in FIGS. 2 and 3, respectively, are to be of sufficient thickness to provide the required protection for the surface wave guiding structure 11 from environmental conditions and missile impact.

Figure 4:
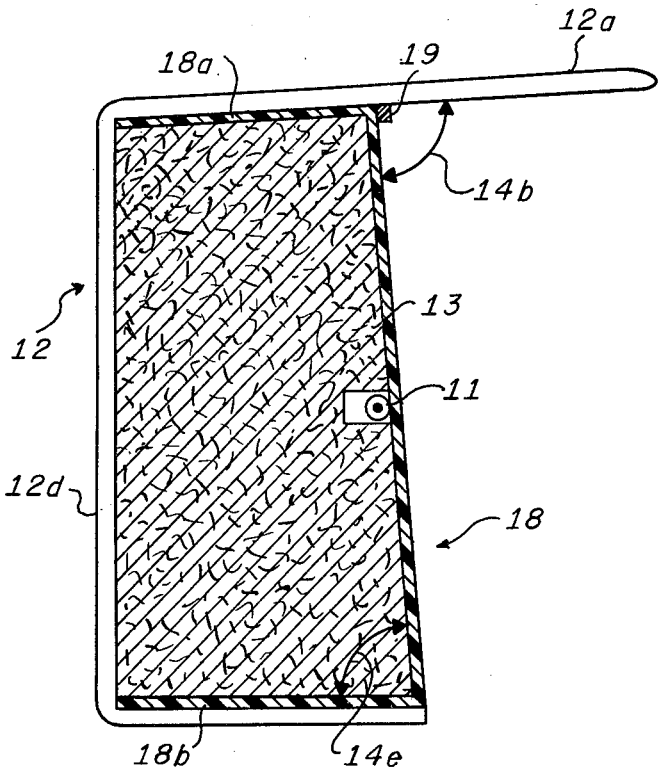

FIG. 4 shows an embodiment of the invention wherein the surface wave guiding structure 11 and support structure 13 are shielded and contained by a C-shaped shield 18 with substantially equal upper 18*a* and lower 18*b* sections with the open end thereof positioned adjacent the interconnecting section 12*d* of the asymmetrical C-shaped channel 12. C-shaped shield 18 may be retained within the channel with a lip 19 extending from the upper section 12*a* of the asymmetrical C-shaped channel 12.

Figure 5:
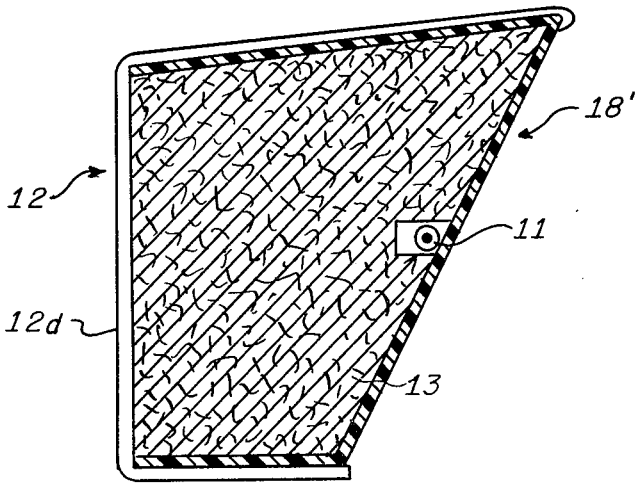

In FIG. 5 an embodiment is shown wherein the surface wave guiding structure 11 and support structure 13 are shielded and contained by an asymmetrical C-shaped shield 18' or dimensions commensurate with the internal dimensions of the C-shaped shield 12 and inserted therein with the open end thereof adjacent to the interconnecting section 12*d*.

Figure 6:
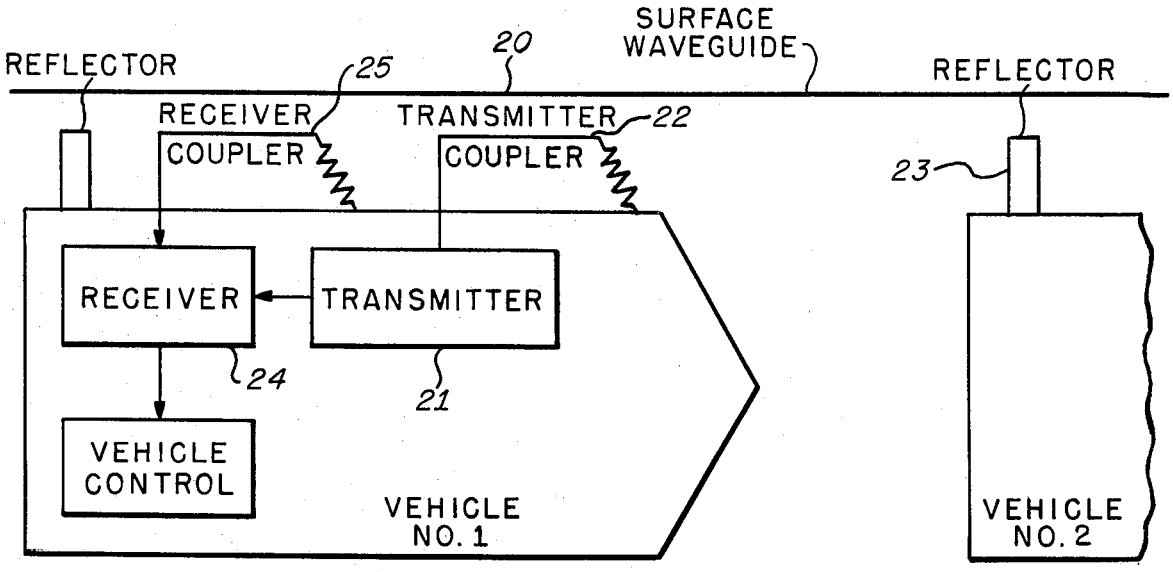
FIG. 6 is a block diagram representation of a system wherein the invention is useful.

The block diagram of a rapid transit system in which the present invention may be utilized is shown in FIG. 6. A surface wave transmission line 20 such as that described above is supported parallel to the rapid transit system vehicle guideway. A transmitter mounted on a vehicle in the guideway, as for example vehicle 1, couples a short pulse signal to the surface wave transmission line 20 via surface wave transmitter coupler 22. Short pulse signals coupled in this manner propagate along the surface wave transmission line 20 to be reflected from a reflector 23, yet to be described, positioned near the rear of the vehicle which precedes vehicle #1 along the guideway, as for example, vehicle #2. Reflected short pulse signals from the reflector 23 propagate along the surface wave transmission line 20 and are coupled to receiver 24 via coupler 25 for utilization in the vehicle control system.

Figure 7:
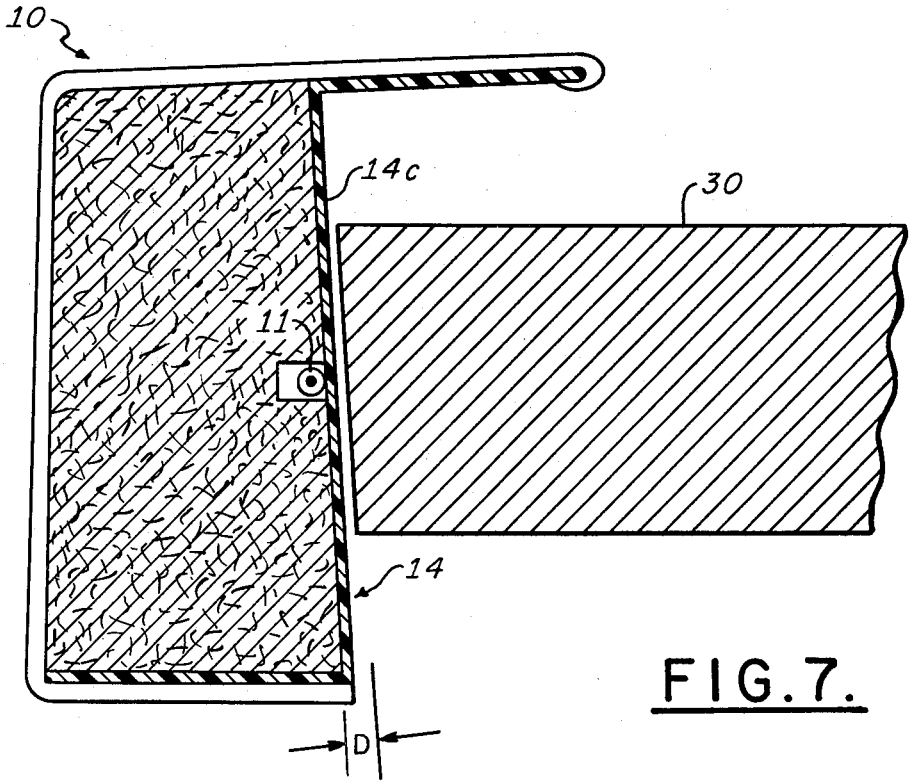
FIG. 7 is a representation in cross-sectional view of the invention with a reflecting object thereabout.

Refer now to FIG. 7 wherein a cross sectional view of a reflector 30 positioned adjacent to surface wave transmission line 10 is shown. Reflector 30 may be a metallic plate extending from the side of the vehicle to be within a predetermined distance D from the interconnecting section 14*c* of the Z-shaped shield 14. Short pulse signals propagating along the surface wave guiding structure 11 will be reflected from reflector 30, the reflection coefficient of which is dependent upon the size of the reflector and the spacing D from the surface wave guiding structure 11.

While the invention has been described in its preferred embodiments, it is to be understood that the words which have been used are words of description rather than of limitation and that changes within the purview of the appended claims may be made without departing from the true scope and spirit of the invention in its broader aspects.

We claim:

1. A transmission line apparatus comprising:

a C-shaped channel having an open side and upper and lower sections of unequal length with an interconnecting section therebetween, said upper section of a length greater than said lower section;

propagation means for guiding signal waves;

means, constructed of a first dielectric material, for supporting said propagation means adjacent said open side of said C-shaped channel; and means, constructed of a second dielectric material, and Z-shaped having an upper section, a lower section and an interconnecting section therebetween, positioned in said C-shaped channel with said upper and lower sections thereof adjacent said upper and lower sections of said C-shaped channel respectively for shielding and containing said propagation means and said support means, said upper section extending from said interconnecting section of said Z-shape along said upper section of said C-shaped channel towards the end of said upper section of said C-shaped channel adjacent said open side and said lower section extending from said interconnecting section of said Z-shape, along said lower section of said C-shaped channel towards said interconnecting section of said C-shaped channel.

2. A transmission line apparatus comprising:

a C-shaped channel having an open side and upper and lower sections of unequal length extending from said open side with an interconnecting section extending therebetween, said upper section of a length greater than said lower section;

propagation means for guiding signal waves;

means, constructed of a first dielectric material, for supporting said propagation means adjacent said open side of said C-shaped channel; and means, constructed of a second dielectric material for shielding and containing said propagation means and said support means, said shield means having an upper section, a lower section and an interconnecting section therebetween, and positioned in said C-shaped channel with said upper and lower sections thereof adjacent said upper and lower sections of said C-shaped channel respectively and said interconnecting means extending between said upper and lower sections thereof adjacent said open side, said shield means positioned such that the ends thereof are located predetermined distances from said interconnecting section of said C-shaped channel with said upper section of said shields means extending along said upper section of said C-shaped channel from said interconnecting section of said shield means substantially to said interconnecting section of said C-shaped channel and said lower section of said shield means extending along said lower section of said C-shaped channel substantially to said interconnecting section of said C-shaped channel.

3. A transmission line apparatus in accordance with claim 2 wherein said predetermined distances from said interconnecting section of said C-shaped channel are respectively substantially equal to said lengths of said upper and lower sections of said C-shaped channel.

4. A transmission line apparatus in accordance with claims 1, 3, or 2 wherein said propagation means is a metallic rod of circular cross section having a third dielectric material thereabout forming a dielectric coated rod of predetermined diameter thereby, creating a surface wave guiding structure and said support means contains a notch for supporting said propagation means, said notch having a height, of dimension substantially equal to and a width greater than said predetermined diameter of said propagation means.

5. A transmission line apparatus in accordance with claim 4 wherein said metallic rod comprises copper, said third dielectric material comprises TEFLON, said first dielectric material comprises STYROFOAM, said second dielectric material comprises ultra high molecular weight polyethylene and said C-shaped channel is constructed of a fourth dielectric material comprising polyvinyl chloride.

6. A transmission line apparatus in accordance with claims 1, 3 or 2 wherein said propagation means is a metallic rod of circular cross section having a third dielectric material thereabout forming a dielectric coated rod of predetermined diameter thereby creating a surface wave guiding structure and said support means and said shield means contain notches, said notches being adjacent to one another such that a rectangular section for supporting said propagation means is formed, said rectangular section having a height of dimension substantially equal to and a width greater than said predetermined diameter of said propagation means.

7. A transmission line apparatus in accordance with claim 6 wherein said notch in said shield means has a height and width substantially equal to said diameter of said propagation means.

8. A transmission line apparatus in accordance with claim 6 wherein said metallic rod comprises copper, said third dielectric material comprises TEFLON, said first dielectric material comprises STYROFOAM, said second dielectric material comprises ultra high molecular weight polyethylene and said C-shaped channel is constructed with a fourth dielectric material comprising polyvinyl chloride.

* * * * *